US012240646B2

(12) United States Patent
Cossais et al.

(10) Patent No.: US 12,240,646 B2
(45) Date of Patent: Mar. 4, 2025

(54) TOOLS FOR FORMING A SEPARATION LINE IN A PACK OF FOOD CUPS

(71) Applicant: SYNERLINK, Puiseux Pontoise (FR)

(72) Inventors: Dominique Cossais, Sainte Geneviève des Bois (FR); Christian Jacquemin, Monéé en Belin (FR); Jérôme Lemoine, Savi'ne L'Eveque (FR); Hervé Delaunay, Achères (FR)

(73) Assignee: SYNERLINK, Puiseux Pontoise (FR)

( * ) Notice: Subject to any disclaimer, the term of this patent is extended or adjusted under 35 U.S.C. 154(b) by 112 days.

(21) Appl. No.: 18/068,729

(22) Filed: Dec. 20, 2022

(65) Prior Publication Data

US 2023/0192341 A1 Jun. 22, 2023

(51) Int. Cl.
*B65B 61/00* (2006.01)
*B65B 51/32* (2006.01)

(52) U.S. Cl.
CPC ..... *B65B 61/007* (2013.01); *B65B 51/32* (2013.01)

(58) Field of Classification Search
CPC ..... B65B 61/007; B65B 51/32; B65B 61/005; B65B 61/06; B65B 61/08; B65B 61/10; B29C 65/7451; B29C 65/745; B29C 65/7457; Y10T 156/1313; Y10T 83/9401; Y10T 156/1052; Y10T 156/1066; Y10T 156/1378; Y10T 83/9411; Y10T 83/9447; Y10T 83/9399; Y10T 83/9372; Y10T 83/8854
See application file for complete search history.

(56) References Cited

U.S. PATENT DOCUMENTS 6,070,507 A * 6/2000 Mihalov ..... B29C 66/81431 83/13
2003/0131699 A1 7/2003 Lai et al.
2004/0173067 A1* 9/2004 Li ..... B23D 35/001 83/13

FOREIGN PATENT DOCUMENTS

| | | | |
|---|---|---|---|
| DE | 202007013402 | U1 | 12/2007 |
| EP | 3766799 | A1 | 1/2021 |
| JP | 2008183094 | A | 8/2008 |
| WO | 2004007156 | A1 | 1/2004 |
| WO | 2021062295 | A1 | 4/2021 |

OTHER PUBLICATIONS

French Search Report and Written Opinion issued on Jul. 18, 2022 in corresponding application No. FR2114046, 22 pgs.

* cited by examiner

*Primary Examiner* — Veronica Martin
(74) *Attorney, Agent, or Firm* — Maier & Maier, PLLC

(57) ABSTRACT

Equipment for making a precut in a pack of food cups, wherein the precuts makes separation by breaking along a separation line between two food cups easier, where the equipment includes at least one knife for making a precut groove and/or a full cut along the separation line and at least one counter-knife.

14 Claims, 7 Drawing Sheets

TOOLS FOR FORMING A SEPARATION LINE IN A PACK OF FOOD CUPS

FIELD

The present disclosure pertains to the field of equipment for separating packs food cups and forming precut lines in such packs of food cups. The present disclosure pertains more specifically to tools for equipment with which to separate food product packs and form precut lines.

BACKGROUND

Food products such as dairy, liquid, creamy, pasty or foamy products in batches or in packs are typically contained in a multi-housing container obtained by shaping plastic material. After shaping, the housings are filled with food product and sealed with a cover. Subsequently, a groove or precut is made for scoring the cover and the plastic over a given depth, allowing separation of the pack into a plurality of cups by breaking. As needed, in some areas, a full cut may be made, for example for separating the packs.

With the goal of increasing the recyclability rates of the cups after use, there's a trend to look towards the use of polyethylene terephthalate (PET) for forming the packs. Recycling of this plastic is in fact common and well managed.

However, in the case where the container is made of PET, there is a need to adapt the groove in order to get a satisfactory separation by breaking.

Document EP 3,766,799 describes equipment for making a precut in a pack of food cups comprising a first cutting tool configured for making a precut groove from above the pack and a second cutting tool configured for making a precut groove from below the pack. With this equipment, the separation of two food product cups by folding and breaking can in fact be made easier for a range of plastics including in particular PET.

However, it was found that, when the force applied by one of the cutting tools is insufficient, the plastic is not sufficiently pressed against the other cutting tool, such that the penetration of the plastic is insufficient for getting a satisfactory precut. Further, a significant force applied to the cutting tool may result in bending. In a case where the cutting tools are configured for passing through all of the plastic (meaning making a complete cut), this bending may result in mechanical contact between the cutting tools and therefore damage them.

There is therefore a need for cutting tools and equipment for forming a precut and/or a full cut that do not have the above disadvantages.

SUMMARY

A knife for an equipment for forming a precut in a pack of food cups is proposed, said precut facilitating a separation by breaking along a separation line between two food cups, wherein the knife comprises a cutting part configured for making a precut groove and/or a full cut along the separation line, where said cutting part extends along a first longitudinal axis, such that, seen in section perpendicular to the longitudinal axis, the cutting part extends on either side of a transverse axis and the cutting part comprises:

on one side of the transverse axis (A):

a first portion extending between a first point forming the end of the cutting portion and a second point, wherein the straight line connecting the first and second points forms a first angle with the transverse axis comprised between 20° and 40°;

a second portion extending between the second point and a third point, wherein the straight line connecting the second and third points forms a second angle with the transverse axis comprised between 15° and 25°; and on the other side of the transverse axis:

a third portion extending between the first point and a fourth point, wherein the fourth point coincides with the transverse axis;

a fourth portion extending from the fourth point to a fifth point, wherein the fifth point is symmetric to the third point about the transverse axis, and wherein the straight line connecting the fourth and fifth points forms a third angle with the transverse axis included between 15° and 25°.

With such a knife shape, sufficient force can be applied to the packs of cups in order to push the plastic against a counter-knife of the equipment for forming a precut. The precut grooves are adapted to the separation of cups by breaking along separation lines and are obtained repeatedly.

Further, such a knife shape limits bending of the knife when a groove is made. The risk of damage to the knife, and in particular the risk that the knife comes into contact with the counter-knife, is reduced.

The characteristics disclosed in the following paragraphs may, optionally, be implemented independently of each other or in combination with each other.

The first portion may extend over a distance, measured along the direction of the transverse axis, comprised between 0.02 mm and 0.2 mm. The first portion contributes to the mechanical strength of the knife when the knife attacks the plastic.

The third portion may extend over a distance, measured along the direction of the transverse axis, included between 0.2 mm and 0.8 mm. The third portion forms a flat surface of the knife that participates in the satisfactory cutting of the plastic. The third portion may face a counter-knife of the equipment, such that the depth of the grooves may be increased until a full cut is made (i.e. passing through the full thickness of the cups) without the knife and the counter-knife meeting.

A distance between the first point and the fifth point, measured along the direction of the transverse axis, may be included between 1.4 mm and 2 mm. The height of the cutting part is then adapted to make groves for making precuts and full cuts over a range of cup thicknesses.

The knife may further comprise a connecting part extending from the cutting part to a body of the knife, where the connecting part extends symmetrically on either side of the transverse axis from the third and fifth points following an angle of opening comprised between 100° and 140°. The connecting part serves to stiffen the knife and thus reduce the risk of bending.

The knife may further comprise a cylindrical portion extending along the direction of the transverse axis. The cylindrical portion makes it easier to mount the knife in the equipment. The cylindrical part may be identical regardless of the profile and shape of the cutting part, such that various knives may be mounted in the same equipment.

According to another aspect, a counter-knife for an equipment for forming a precut in a pack of food cups is proposed, said precut facilitating a separation by breaking along a separation line between two food cups, where the counter-knife comprises an active part configured for making a precut groove and/or a full cut along the separation line, wherein said counter-knife extends along a second longitudinal axis such that, seen in section perpendicular to the longitudinal axis, the active part comprises:

an edge defining a flat surface of the active part;

a first segment extending between a first point forming the end of the active part and a second point, wherein a straight line connecting the first and second points forms a first angle with the edge comprised between 20° and 40°;

a second segment extending from the second point to a third point, wherein the straight line connecting the second and third points forms a second angle with the edge comprised between 15° and 25°.

Such a counter-knife shape assures sufficient penetration of the plastic when a force is applied to the cups by a knife of the equipment for forming a precut. The precut grooves are adapted to the separation of cups by breaking along separation lines and are obtained repeatedly. Further, such a counter-knife shape limits bending of the counter-knife when a groove is made. The risk of damage, and in particular the risk that the counter-knife comes into contact with the knife, is reduced.

The characteristics disclosed in the following paragraphs may, optionally, be implemented independently of each other or in combination with each other.

The first segment may extend over a distance, measured along the direction of the edge, comprised between 0.02 mm and 0.2 mm. The first segment contributes to the mechanical strength of the counter-knife when the counter-knife attacks the plastic.

The edge may extend over a distance comprised between 0.02 mm and 0.1 mm. The third edge forms a flat surface of the counter-knife which participates in the satisfactory cutting of the plastic. The edge may face a knife of the equipment, such that the depths of the grooves may be increased until a full cut is obtained without the knife and the cutting block meeting.

The edge may further comprise a body of substantially rectangular section, wherein the second segment is connected to the body by a chamfer extending from the third point. Thus, the counter-knife is sufficiently stiff to bear the forces applied on the counter-knife when a groove or full cut is made.

According to another aspect, an equipment is proposed for making a precut in a pack of food cups, where said precut facilitates separation by breaking along a separation line between two food cups, wherein the equipment comprises:

at least one knife, and at least one counter-knife, wherein a flat surface of the counter-knife faces the third portion of the knife.

Such an equipment assures that the knife forces the cups against the counter-knife in order to repeatedly obtain a satisfactory precut. Further, the shape of the knife and the counter-knife limits bending thereof. The risk of damage to the knife and the counter-knife, and in particular the risk that the knife comes into contact with the counter-knife, is reduced.

The characteristics disclosed in the following paragraphs may, optionally, be implemented independently of each other or in combination with each other.

A distance between the knife and the counter-knife may be comprised between 0.003 mm and 0.1 mm. Such a distance, also called unclipping, enables to increase the height of the grooves made in the plastic for reaching a full cut. In fact, the unclipping serves to avoid mechanical contact between the knife and the counter-knife during a full cut.

The equipment may comprise an upper support plate receiving the knife and a lower support plate receiving the counter-knife, wherein the pack of food cups is configured to be received between the upper support plate and the lower support plate, wherein the upper support plate and the lower support plate have a relative displacement perpendicular to the plane defined by the upper surface of the food product cups. The precutting equipment is then shaped like a press, and the depth of penetration of the knives and the counter-knife into the plastic of the pack can be controlled. The control of the penetration depths may be at least in part provided because of the relative spacing and movement between the upper and lower support plates.

According to another aspect, a facility is proposed for preparing packs of food cups comprising:

a first equipment configured for simultaneously performing a sealing operation of a cover and a localized cooling operation from below of the junction zones between the cups;

and, arranged downstream from the first equipment, a second equipment to form a precut.

According to another aspect, a pack of food product cups obtained either by the equipment or by the facility is proposed.

BRIEF DESCRIPTION OF THE DRAWINGS

Other characteristics, details and advantages will appear upon reading the following detailed description and analyzing the attached drawings, on which.

DETAILED DESCRIPTION

Figure 1:
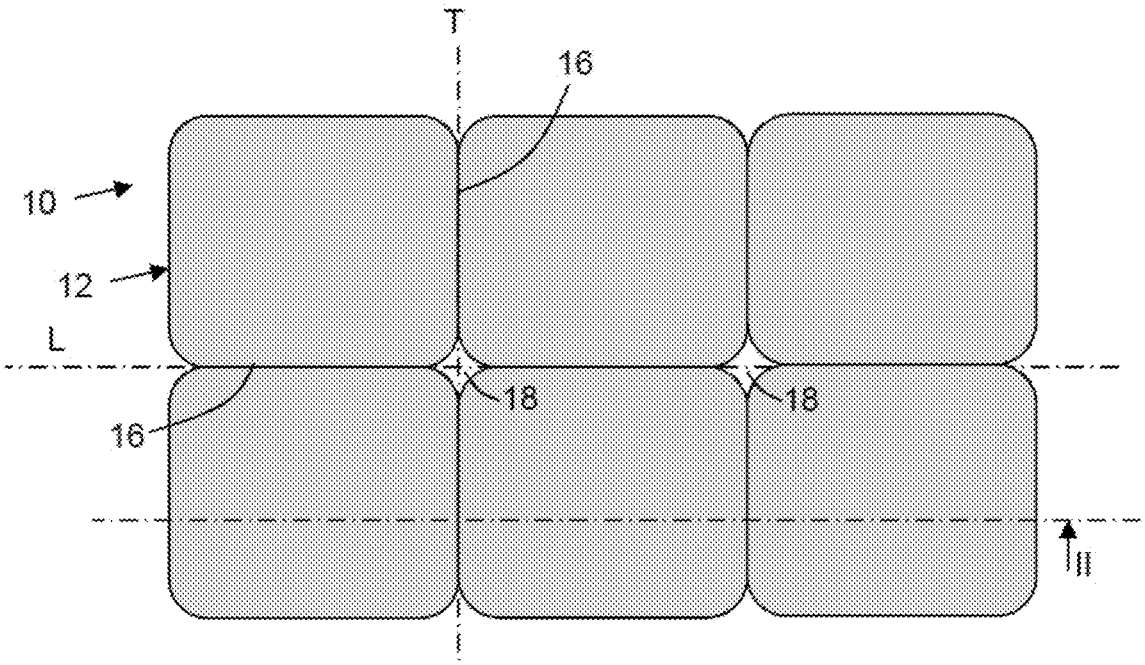
FIG. 1 schematically shows a top view of a pack of food cups according to an embodiment.
Figure 2:
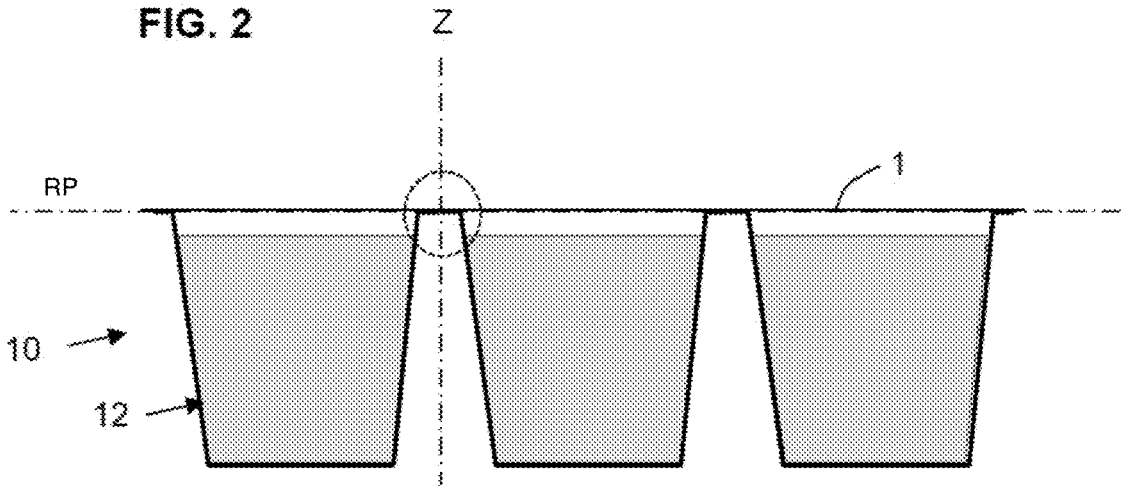
FIG. 2 schematically shows a side view of the pack of food cups of FIG. 1 according to an embodiment.

FIGS. 1 and 2 represent a pack 10 of food cups 12. The food product may be a conventional food or a nutraceutical. The food product may be any type of dairy food. The product may be liquid, creamy, pasty or foamy.

The term 'pack' must be understood to include a set forming a lot for sale, where this set includes several units for individual consumption (here each unit is called 'cup' or 'tub'). Each unit for individual consumption forms a food serving for an individual who, after consumption, discards the empty cup, meaning the primary packaging, in a trashcan or recycling circuit.

In the illustrated example, a pack 10 of six cups 12 is shown. It must however be understood that the number of cups 12 is arbitrary, meaning that the pack 10 may comprise two cups, four cups, six cups, eight cups, or even nine cups, ten cups and also twelve cups.

In the example shown, a reference plane RP is defined by the upper surface of the cups 12, wherein the reference plane RP comprises a longitudinal direction referenced L and a transverse direction referenced T. A vertical direction referenced Z, substantially normal to the reference plane RP, is also defined.

The food product cups 12, seen in transverse section (perpendicular to the reference plane RP), may have a slightly conical shape like the one shown in FIG. 2. In a variant, there is no conicity and the sides of the cups 12 may be strictly parallel to the vertical (meaning parallel to the vertical axis Z). The food product cups 12 may also be cups 12 with convex lateral walls, which cannot be molded by a simple mold.

The cups 12 are formed from a multi-housing container. The multi-housing container may be made of plastic. The material used to form the multi-housing container may be polyethylene terephthalate (PET). Note that translucent PET or opaque PET may be used. Alternatively, the material used to form the multi-housing container may be polypropylene (PP). The plastic may be blown or injected in a mold resulting in the multi-housing container.

The thickness, referenced e2, of the plastic of the container may be substantially uniform over all of the multi-housing container. The thickness e2 is typically included between 0.6 mm and 2 mm, at least around the junction zones between the cups 12.

The cups 12 are, after they're formed, filled with food product and sealed with a cover sheet 14. The cover sheet 14 extends over the upper surface of the cups 12, meaning parallel to the reference plane RP. The thickness, referenced e1, of the cover sheet 14 is typically included between 0.03 mm and 0.1 mm. The material making up the cover sheet 14 may be formed by a multilayer assembly, with a very thin layer of aluminum, and a decorative and/or labeling layer.

It is expected that separation lines 16 will be made on all the sides where a connection joins one cup 12 to a neighboring cup 12. These separation lines 16 are fold lines that break when one cup 12 is tilted relative to another. Because of the separation lines 16, each cup 12 can be separated from the others for individual consumption. Forming star-shaped holes 18 at the corners between four cups 12 is also expected. These holes 18 make the separation of cups 12 even easier.

Figure 3:
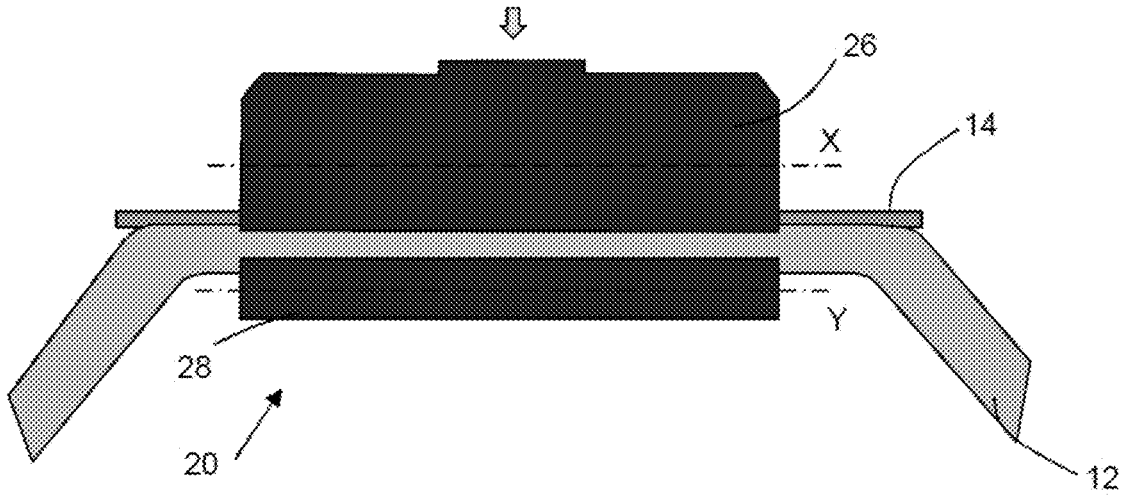
FIG. 3 schematically shows a front view of an equipment for forming precuts near a separation zone between two food cups according to an embodiment.
Figure 4:
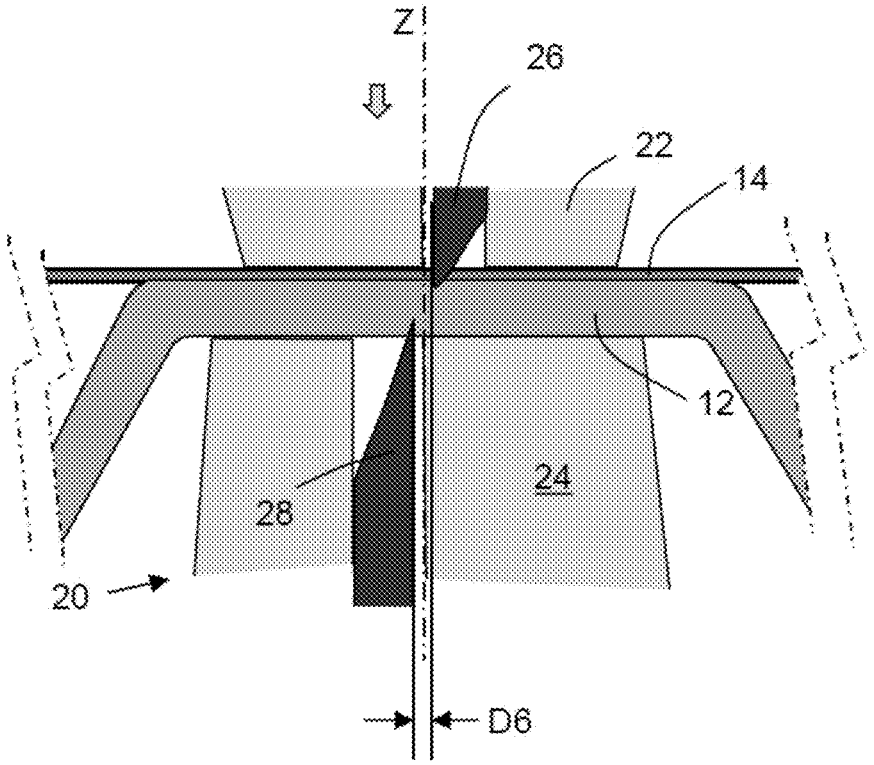
FIG. 4 schematically shows a transverse section view of the equipment of FIG. 3.

An equipment for forming a precut 20 is used to form the separation lines 16 and the holes 18. The equipment for forming a precut 20 has the form of a press. The equipment for forming a precut 20 essentially comprises an upper support plate 22 and a lower support plate 24. As can be seen in FIG. 3, the packs 10 are received between the lower and upper support plates 22, 24.

The upper support plate 22 and the lower support plate 24 have a relative motion along the direction of the vertical axis Z, which is the direction normal to the reference plane RP when a pack 10 of cups 12 is placed in the equipment 20. Here, the upper support plate 22 may be moved along the vertical axis Z while the lower support plate 24 is fixed. Alternatively, the lower support plate 24 could be moved along the vertical axis Z, or both the upper and lower plates 22, 24 could be mobile along the vertical axis Z.

Here, the upper support plate 22 receives one or more knives 26. When a pack 10 of cups 12 is placed between the lower and upper support plates 22, 24, knives 26 extend above separation lines 16. Thus, the knives 26 are suited to form a precut groove from above along the separation line 16.

Note that the upper support plate 22 may also receive one or more star-shaped punches. When a pack 10 of cups 12 is placed between the support plates 22, 24, star-shaped punches are located at the holes 18. The star-shaped holes 18 can then be cut by the punches.

The lower support plate 24 receives at least one counter-knife 28. When a pack 10 of cups 12 is placed between the lower and upper support plates 22, 24, the counter-knifes 28 extend below the separation lines 16. Thus, the counter-knifes 28 are suited to form a precut groove from below along the separation line 16.

The number of knives 26 and counter knifes 28 may correspond to the number of separation lines 16 to be made, such that only one movement between the upper support plate and the lower support plate 22, 24 is sufficient to form all the separation lines 16 in a pack 10. It is also possible to provide sufficient knives 26 and counter-knifes 28 to process several packs 10 at the same time. The productivity of the equipment 20 is then increased.

Figure 5:
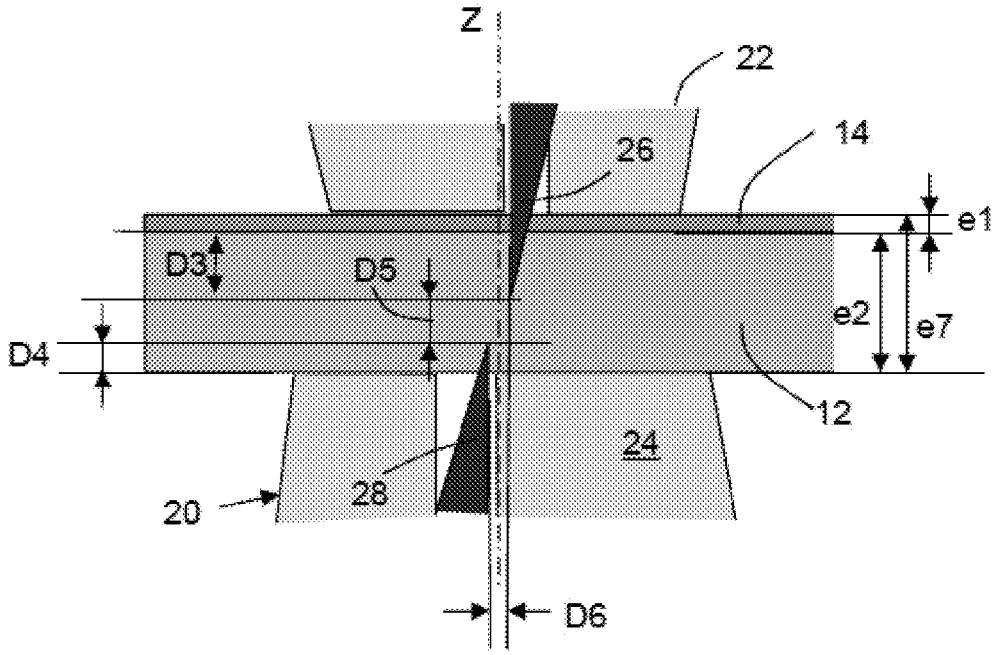
FIG. 5 shows a detail of FIG. 4.

As is more visible in FIG. 5, the penetration depths of the knives 26 and the counter-knifes 28 into the plastic of the pack 10 is controlled, in particular because of the precision of the press. The control of the penetration depths may be obtained in part or in whole because of the relative spacing and movement between the upper and lower support 22, 24 plates. In this case, the spacing between the two support plates 22, 24 is fixed in the working position at a dimension e7, which is the sum of the thicknesses e1 of the cover sheet 14 and the thickness e2 of the plastic at the junction between the cups 12.

As shown in FIG. 5, each knife 26 makes a groove over a height D3, from the top of the pack 10, and each counter-knife 28 makes a groove over a height D4 from the bottom of the pack 10.

The height D3 of the groove made by the knife 26 is comprised between 10% and 80% of the thickness e2 of the plastic, preferably between 20% and 60% of the thickness e2 of the plastic. The knife 26 can also entirely groove the thickness E1 of the cover sheet 14. The height D4 of the groove made by the counter-knife 28 is for comprised between 25% and 50% of the thickness e2 of plastic, also preferably 30% and 40%. In this case, the height D3 of the groove made by the knife 26 is greater than the height D4 of the groove made by the counter-knife 28. Such grooves provide a good separation of the cups 12 along the precut lines 16.

A remaining distance D5 which is not cut is defined, either by the knife 26, or by the counter-knife 28. This remaining distance D5 is sufficient for the connecting zones between the cups 12 to allow the pack 10 of cups 12 to be lifted by only one or two cups 12 without holding the other cups 12. For example, the remaining distance D5 is comprised between 20% and 60% of the thickness e2 of the plastic. Preferably, the remaining distance D5 is comprised between 25% and 45% of the plastic.

Further, a distance D6 separating the knife 26 from the counter-knife 28, measured along the direction normal to the vertical axis Z is comprised between 0.003 and 0.1 mm. Such a distance D6, also called unclipping, enables to increase the height of the grooves made in the plastic for making a full cut, which is passing through all of the dimension e7 (the sum of the thicknesses e1 of the cover sheet 14 and the thickness e2 of the plastic material at the junction between the cups 12). In fact, the unclipping serves to avoid mechanical contact between the knife 26 and the counter-knife 28 during a full cut. A separation between several packs 10 of food cups 12 can be achieved with a full cut, for example.

Figure 6:
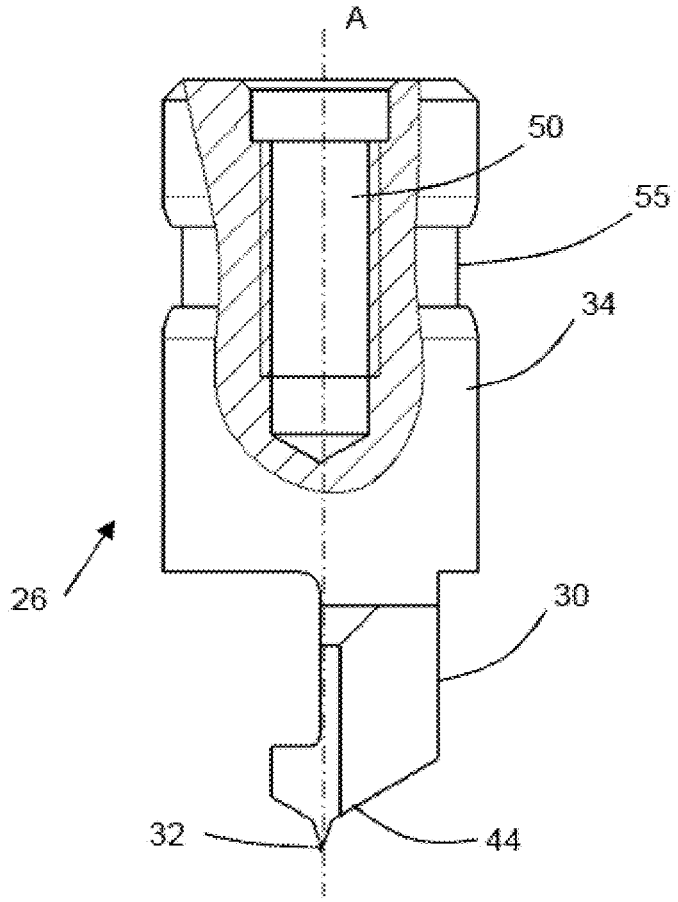
FIG. 6 schematically shows a side view of a knife which may be used in the equipment of FIG. 3.

Subsequently, a knife 26 is described. As shown in FIG. 6, here, the knife 26 is received in the upper plate 22 of the equipment 20, to be moved along the direction of the vertical axis Z and make a precut from above.

The knife 26 essentially comprises a cutting part 32 intended to come into contact with the plastic, a body 30 assuring the stiffness of the knife 26, and a cylindrical part 34 intended to allow mounting of the knife 26 in the upper support plate 22 of the equipment 20.

The cutting part 32 extends along a longitudinal axis X. When the knife 26 is received in the upper support plate 22, the cutting part 32 extends along a separation line 16. The cutting part 32 is intended to cut the packs 10 of cups 12 to form separation lines 16.

Figure 7:
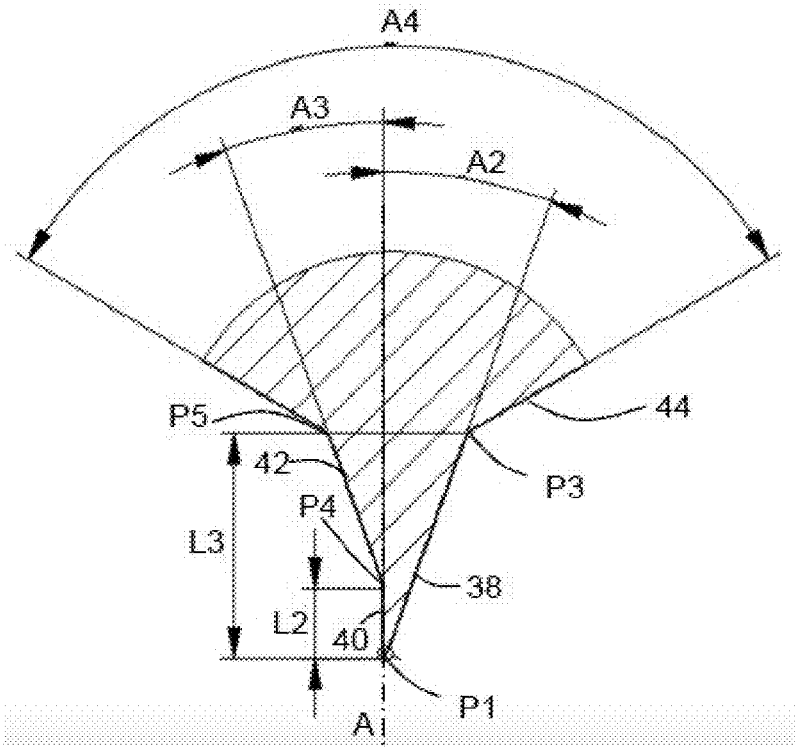
FIG. 7 shows a detail of FIG. 6.
Figure 8:
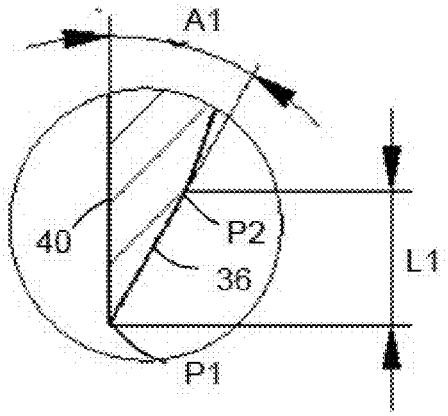
FIG. 8 shows a detail of FIG. 7.
Figure 9:
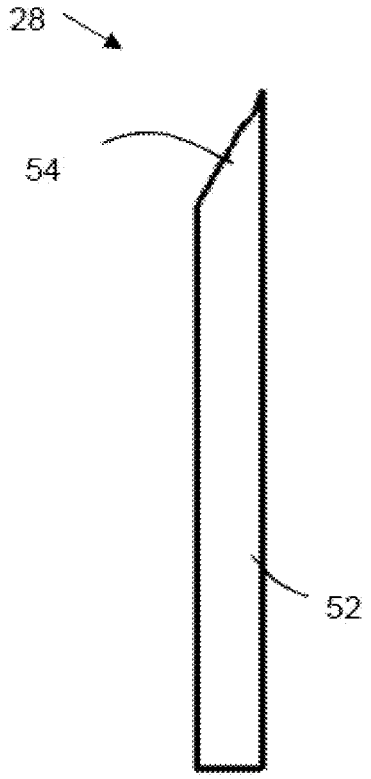
FIG. 9 schematically shows a side view of a counter-knife which may be used in the equipment of FIG. 3.

As can be seen in FIGS. 7 and 8, in side view, the cutting part 32 extends from one side to another of a transverse axis A of the knife 26, from a free end of the cutting part 32 to a connecting part 44, connecting the cutting part 32 to the body 30.

On one side of the transverse axis A, intended to be opposite the counter-knife 28 when the knife 26 is housed in the upper support plate 22, the cutting part 32 defines a first portion 36, a second portion 38 and a third portion 40.

The first portion 36 extends from a first point P1 forming the end of the cutting part 32 to a second point P2. A straight line connecting the first and second points P1, P2 forms a first angle A1 with the transverse axis A comprised between 20° and 40°. The first portion 36 extends over a distance L1, measured along the direction of the transverse axis A, comprised between 0.02 mm and 0.2 mm. The first portion 36 contributes to the mechanical strength of the knife 26 when the knife 26 attacks the plastic.

The second portion 38 extends from the second point P2 to the third point P3. A straight line connecting the second and third points P2, P3 forms a second angle A2 with the transverse axis A comprised between 15° and 25°. The second angle A2 serves to reduce the penetration forces experienced by the cutting part 32. Further, the second angle A2 participates in exerting a force on the lower support plate 24 to push the plastic against the counter-knife 28. The grooves from underneath, made by the counter-knife 28, are improved.

On the other side of the transverse axis A, meaning the side intended to face the counter-knife 28 when the knife 26 is received in the upper support plate 22, the cutting part 32 comprises a third portion 40 and a fourth portion 42.

The third portion 40 extends from the first point P1 forming the end of the knife 26 and a fourth point P4 coinciding with the transverse axis A. The third portion 40 forms a flat surface of the cutting part 32. The third portion 40 extends over a distance L2, measured along the direction of the transverse axis A, comprised between 0.2 and 0.8 mm.

The fourth portion 42 extends from the fourth point P4 to the fifth point P5. A straight line connecting the fourth and fifth points P4, P5 forms a third angle A3 with the transverse axis A between 15° and 25°. The fourth portion 42 serves to balance the cutting force on both sides of the transverse axis A, so as to reduce the bending brought on by the second angle A2 of the second portion 36. The fourth portion 42 also participates in pushing the plastic on the counter-knife 28, to improve the groove from below, in particular by assuring that the counter-knife 28 penetrates the plastic over the height D4 for cutting from below.

The third and fifth points P3, P5 are symmetric about the transverse axis A. The connecting part 44 extends on both sides of the transverse axis A from the points P3 and P5 to connect the cutting part 32 to the body 30 of the knife 26. A distance L3 between the first point P1 forming the end of the knife 26 and the third and fifth points P3, P5, measured along the direction of the transverse axis A, is comprised between 1.4 and 2 mm. In other words, the height of the cutting part 32 is comprised between 1.4 and 2 mm.

The connecting part 44 extends symmetrically on either side of the transverse axis A according to an opening angle A4 comprised between 100° and 140°. The opening angle A4 serves to stiffen the knife 26 to avoid bending of the knife 26.

Returning to FIG. 6, the body 30 extends along the longitudinal axis X. The body 30 has a polygonal section, to give the knife 26 sufficient stiffness for resisting the forces applied on the knife 26 during a precut. The section of the body 30 is adapted for being received in a housing or slider of the upper plate 22, in particular to provide good orientation of the knife 26 in the upper plate 22. The cutting part 32 may project from the housing or slider according to the height of the groove to be made.

The cylindrical portion 34 extends from the body 30 along the direction of the transverse axis A. The cylindrical portion 34 extends from a side of the body 30 opposite the cutting part 32. The axis of revolution of the cylindrical part 34 corresponds to the transverse axis A. The cylindrical portion 34 may be received in a cylindrical housing formed in the upper plate 22 of the equipment 20. The cylindrical part 34 may be identical whatever the profile and shape of the cutting part 32, such that various knives 26 may be housed in the same cylindrical housing of the upper plate 22.

Here a threaded hole 50 is formed in the cylindrical portion 34. The threaded hole 50 extends along the axis of revolution A of the cylindrical portion 34 from an upper surface of the cylindrical portion 34 towards the cutting part 32. The threaded hole 50 is adapted to receive a retaining screw of the equipment 20. Mounting of the cutting tool 30 by the retaining screw allows a precise adjustment of the position of the knife 26 in the upper plate 22. In fact, it is possible to finely adjust the cut height of the knife 26, by inserting the retaining screw more or less in the threaded hole 50.

Further, the cylindrical portion 34 here comprises a cylindrical groove 55 with an axis coinciding with the axis of revolution A of the cylindrical portion 34. The cylindrical groove 55 assures a good propagation of grease around the cylindrical portion 34 for fluidifying the relative movement between the cutting tool 30 and the upper support plate 22.

Subsequently, a counter-knife 28 is described. Here, the counter-knife 28 is received in the lower support plate 24 of the equipment 20 in order to make a precut groove from underneath. In this case, the force applied by the knife 26 forces the plastic against the counter-knife 28. Because of the shape of the cutting part 32 of the knife 26 described above, the plastic is sufficiently pushed against the counter-knife 28 to make a satisfactory and repeatable groove from underneath.

The counter-knife 28 extends along the Y longitudinal axis. When the counter knife 28 is received in the lower support plate 24, the counter-knife 28 extends along a separation line 16.

The counter-knife 28 comprises an active part 54 intended to cut the plastic, and a body 52 intended to be received in the lower plate 24.

Figure 10:
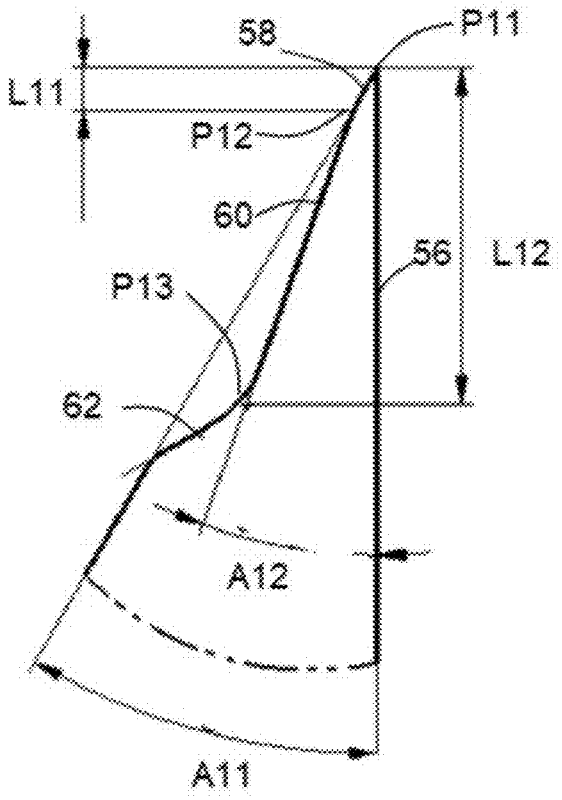
FIG. 10 shows a detail of FIG. 9.

Seen from the side, as shown in FIG. 10, the active part 54 comprises an edge 56. The edge forms a flat surface of the active part 54. The flat surface is intended to face the knife 26 when the counter-knife 28 is received in the lower support plate 24.

The upper part 54 also defines a first segment 58. The first segment 58 extends from a first point P11 of the active part 54 forming the free end of the active part 54 and the second point P12. A straight line connecting the first and second points P11, P12, forms a first angle A11 with the edge 56 comprised between 20° and 40°. The first segment 58 extends over a distance L11, measured along the direction of the edge 56, comprised between 0.02 and 0.2 mm. The first segment 58 contributes to the mechanical strength of the counter-knife 28 when the counter-knife 28 attacks the plastic.

The active part 54 further defines a second segment 60. The second segment 60 extends from the second point P12 towards a third point P13 by forming a second angle A12 with the edge 56 comprised between 15° and 25°. The second segment 60 contributes to reducing penetration forces experienced by the active part 54 and therefore reducing bending.

A chamfer 62 extends from the third part P13 to connect the second segment 60 to the body 52 of the counter-knife 28. The edge 56, for its part, extends in continuity with a side of the body 52.

The body 52 here has a substantially rectangular section. The body 52 may be received in a housing or slider of the lower plate 24 in order to assure the proper orientation of the counter-knife 28 in the lower plate 24. The active part 54 may project from the housing or slider according to the height of the groove to be made.

The invention is not limited to the examples described in light of the figures and other embodiments will appear clearly to the person skilled in the art.

For example, the lower support plate 24 could receive one or more knives 26 and the upper support plate 22 could receive one or more counter-knifes 28. This embodiment appears attractive when the lower support plate 24 is mobile along the direction of the vertical axis Z.

Further, the equipment 20 described below may be part of a facility. The facility may comprise first equipment configured for executing a step of sealing the cover 14 onto the pack 10 of cups 12 and the step of localized cooling of the junction zone between the cups 12 and equipment for forming a precut 20 such as described above.

In this case, the first equipment comprises sealing electrodes suited to contact the upper surface of the pack 10 and a contact counterpart suited for contacting the junction zone between the cups 12 from below. The contact counterpart is preferably heat controlled, for example by circulation of an ice water fluid or other low temperature fluid in the counterpart. The sealing electrodes and the cooling counterpart sandwich the junction zone covered by the cover. Good pressure by the cooling counterpart can thus be guaranteed and thus a good heat conduction transfer coefficient in the contact zone. Since the cooling is localized, it is selective and it does not significantly affect the food product contained in the cups 12.

The invention claimed is:

1. A knife for an equipment for forming a precut in a pack of food cups, said precut facilitating separation by breaking along a separation line between two food cups, wherein the knife comprises a cutting part configured for making a precut groove or a full cut along the separation line, wherein said cutting part extends along a first longitudinal axis, such that, seen in section perpendicular to the longitudinal axis, the cutting part extends on either side a transverse axis and the cutting part comprises:

on one side of the transverse axis:

a first portion extending between a first point forming an end of the cutting portion and a second point, wherein a straight line connecting the first and second points forms a first angle with the transverse axis comprised between 20° and 40°; and a second portion extending between the second point and a third point, wherein a straight line connecting the second and third points forms a second angle with the transverse axis comprised between 15° and 25°; and on an other side of the transverse axis:

a third portion extending between the first point and a fourth point, wherein the fourth point coincides with the transverse axis; and a fourth portion extending from the fourth point to a fifth point, wherein the fifth point is symmetric to the third point about the transverse axis, and wherein the straight line connecting the fourth and fifth points forms a third angle with the transverse axis comprised between 15° and 25°.

2. The knife according to claim 1, wherein the first portion extends over a distance, measured along a direction of the transverse axis, comprised between 0.02 mm and 0.2 mm.

3. The knife according to claim 1, wherein the first portion extends over a distance, measured along a direction of the transverse axis, comprised between 0.2 mm and 0.8mm.

4. The knife according to claim 1, wherein a distance between the first point and the fifth point, measured along a direction of the transverse axis, is comprised between 1.4mm and 2 mm.

5. The knife according to claim 1, further comprising a connecting part extending from the cutting part to a body of the knife, wherein the connecting part extends symmetrically on either side of the transverse axis from the third and fifth points following an angle of opening comprised between 100° and 140°.

6. The knife according to claim 1, further comprising a cylindrical portion extending along a direction of the transverse axis.

7. A counter-knife for an equipment for forming a precut in a pack of food cups, wherein the counter-knife is adapted to cooperate with the knife according to claim 1, said precut facilitating separation by breaking along the separation line between two food cups, wherein the counter-knife comprises an active part configured for making the precut groove or the full cut along the separation line, wherein said counter-knife extends along a second longitudinal axis such that, seen in section perpendicular to the second longitudinal axis, the active part comprises:

an edge defining a flat surface of the active part;

a first segment extending between a first point forming an end of the active part and a second point, wherein a straight line connecting the first and second points forms a first angle with the edge comprised between 20° and 40°; and a second segment extending between the second point and a third point, wherein a straight line connecting the second and third points forms a second angle with the edge comprised between 15° and 25°.

8. The counter-knife according to claim 7, wherein the first segment extends over a distance, measured along a direction of the edge, comprised between 0.02 mm and 0.1 mm.

9. The counter-knife according to claim 7, wherein the edge extends over a distance comprised between 0.02 mm and 0.1 mm.

10. The counter-knife according to claim 7, further comprising a body of substantially rectangular section, wherein the second segment is connected to the body by a chamfer extending from the third point.

11. Equipment for making a precut in a pack of food cups, wherein said precut facilitates separation by breaking along a separation line between two food cups, wherein the equipment comprises:

at least one knife according to claim 1, and at least one counter-knife for an equipment for forming the precut in a pack of food cups, wherein the counter-knife is adapted to cooperate with said at least one knife, said precut facilitating separation by breaking along a separation line between two food cups, wherein the counter-knife comprises an active part configured for making the precut groove or the full cut along the separation line, wherein said counter-knife extends along a second longitudinal axis such that, seen in section perpendicular to a longitudinal axis, the active part comprises:

an edge defining a flat surface of the active part;

a first segment extending between a first point forming an end of the active part and a second point, wherein a straight line connecting the first and second points forms a first angle with the edge comprised between 20° and 40°; and a second segment extending between the second point and a third point, wherein a straight line connecting the second and third points forms a second angle with the edge comprised between 15° and 25°, wherein a flat surface of the counter-knife faces the third portion of the knife.

12. The equipment according to claim 11, wherein a distance between the knife and the counter-knife is comprised between 0.003 mm and 0.1 mm.

13. The equipment according to claim 11, comprising an upper support plate receiving the knife and a lower support plate receiving the counter-knife, wherein the pack of food cups is configured to be received between the upper support plate and the lower support plate, wherein the upper support plate and the lower support plate have a relative displacement perpendicular to a plane defined by an upper surface of the food cups.

14. A facility for preparing packs of food cups comprising:

a first equipment configured for simultaneously making a sealing operation of a cover and a localized cooling operation of junction zones of cups from below; and, arranged downstream from said first equipment, a second equipment for making a precut, where said second equipment conforms to claim 11.

* * * * *